US010915132B1

(12) United States Patent
Liu

(10) Patent No.: US 10,915,132 B1
(45) Date of Patent: Feb. 9, 2021

(54) SUB-THRESHOLD REGION BASED LOW DROPOUT REGULATOR

(71) Applicant: HIMAX TECHNOLOGIES LIMITED, Tainan (TW)

(72) Inventor: Yu-Hsuan Liu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 60 days.

(21) Appl. No.: 16/601,531

(22) Filed: Oct. 14, 2019

(51) Int. Cl.
*G05F 3/26* (2006.01)

(52) U.S. Cl.
CPC ..... *G05F 3/262* (2013.01)

(58) Field of Classification Search
CPC . G05F 3/262; G05F 3/18; G05F 3/185; G05F 3/227; G05F 3/247; G05F 3/26; G05F 3/245; G05F 3/24
USPC ..... 323/314
See application file for complete search history.

(56) References Cited

U.S. PATENT DOCUMENTS 6,972,550 B2 12/2005 Hong
2017/0077907 A1* 3/2017 Su ..... H02M 3/07

* cited by examiner

*Primary Examiner* — Thienvu V Tran
*Assistant Examiner* — Lorena D Bruner
(74) *Attorney, Agent, or Firm* — JCIPRNET

(57) ABSTRACT

A low dropout (LDO) regulator is configured to generate an LDO voltage. The LDO regulator includes at least one current mirror and at least one resistor. The at least one current mirror operates in a sub-threshold region. A first terminal of the at least one resistor is directly coupled to the at least one current mirror. A second terminal of the at least one resistor is directly coupled to a power line.

8 Claims, 2 Drawing Sheets

SUB-THRESHOLD REGION BASED LOW DROPOUT REGULATOR

BACKGROUND OF THE INVENTION

1. Field of the Invention

The present invention relates to a voltage generating circuit, and particularly relates to a sub-threshold region based low dropout (LDO) regulator.

2. Description of Related Art

A low dropout (LDO) regulator is a commonly used power management circuit for regulating a stable voltage source (i.e., not related to an output load, an input voltage and temperature). A basic LDO regulator includes a bandgap voltage generator, an error amplifier and a power transistor. In order to achieve an ultra-low quiescent current, a sub-threshold technology is applied to the LDO regulator. However, due to current mismatch in process variation, a sub-threshold region is not easily controlled.

It should be noted that the information disclosed in this Background section is only for enhancement of understanding of the background of the invention and therefore it may contain some information (or all information) that does not form the prior art that is already known to a person of ordinary skill in the art. Further, the information disclosed in the Background section does not mean that one or more problems was acknowledged by a person of ordinary skill in the art.

SUMMARY OF THE INVENTION

The present invention provides a low dropout (LDO) regulator, which may operate more stably in a sub-threshold region.

An LDO regulator of the present invention is configured to generate an LDO voltage. The LDO regulator includes at least one current mirror and at least one resistor. A first terminal of the at least one resistor is directly coupled to the at least one current mirror. A second terminal of the at least one resistor is directly coupled to a power line.

An LDO regulator of the present invention is configured to generate an LDO voltage. The LDO regulator includes at least one transistor and at least one resistor. The at least one transistor operates in a sub-threshold region. A first terminal of the at least one resistor is directly coupled to the at least one transistor. A second terminal of the at least one resistor is directly coupled to a power line.

Based on the above, the LDO regulator of the embodiments of the present invention is provided with the resistor having a large resistance value. The resistor is disposed between the element operating in the sub-threshold region and the power line, and is non-sensitive to current disturbance. Therefore, the resistor may effectively reduce current mismatch in process variation, which makes the LDO regulator work more stably in the sub-threshold region.

In order to make the aforementioned and other objectives and advantages of the present invention comprehensible, embodiments accompanied with figures are described in detail below.

DESCRIPTION OF THE EMBODIMENTS

Figure 1:
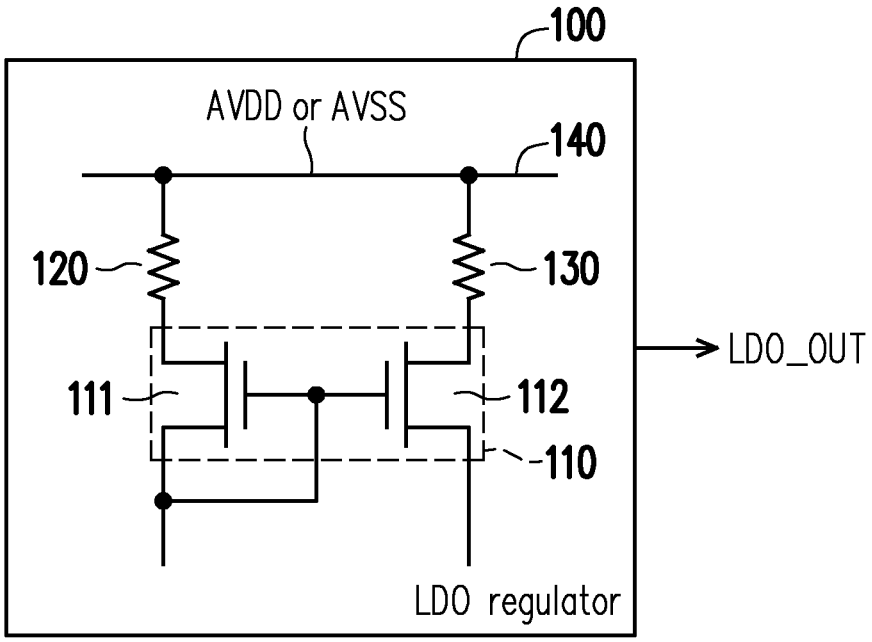
FIG. 1 is a schematic circuit block diagram of a low dropout (LDO) regulator according to one embodiment of the present invention.

The term "coupled (or connected)" used in the entire specification (including the claims) may mean any direct or indirect connection means. For example, a first device coupled (connected) to a second device described herein should be interpreted as that the first device may be directly connected to the second device, or that the first device may be indirectly connected to the second device by other devices or by some means of connection. Terms such as "first" and "second" used in the entire specification (including the claims) are used to name components (elements) or to distinguish between different embodiments or ranges, and are not intended to define the upper or lower limit of the number of components or the order of components. Wherever possible, the same reference numbers are used in the drawings and the description to refer to the same or like parts, components or steps. For parts, components or steps denoted by same reference numbers or names, reference can be made to the related descriptions.

FIG. 1 is a schematic circuit block diagram of a low dropout (LDO) regulator according to one embodiment of the present invention. The LDO regulator 100 is configured to generate an LDO voltage LDO_OUT. The LDO regulator 100 includes at least one current mirror 110. The current mirror 110 operates in a sub-threshold region. The LDO regulator 100 further includes at least one resistor, such as a resistor 120 and a resistor 130 shown in FIG. 1. A first terminal of the resistor 120 is directly coupled to a first terminal of a master current path of the current mirror 110. A first terminal of the resistor 130 is directly coupled to a first terminal of a slave current path of the current mirror 110. Second terminals of the resistor 120 and the resistor 130 are directly coupled to a power line 140. The power line 140 is configured to transmit a system voltage AVDD or a grounding voltage AVSS.

In the embodiment shown in FIG. 1, the current mirror 110 includes at least two transistors, such as a transistor 111 and a transistor 112 shown in FIG. 1. The transistor 111 and the transistor 112 operate in a sub-threshold region. According to design requirements, the transistor 111 and the transistor 112 may be p-channel metal oxide semiconductor (PMOS) transistors, n-channel metal oxide semiconductor (NMOS) transistors or other transistors. A first terminal (e.g., a source) of the transistor 111 acts as the first terminal of the master current path of the current mirror 110. A control terminal (e.g., a gate) of the transistor 111 is coupled to a second terminal (e.g., a drain) of the transistor 111, and the second terminal of the transistor 111 acts as the second terminal of the master current path of the current mirror 110. A first terminal (e.g., a source) of the transistor 112 acts as the first terminal of the slave current path of the current mirror 110. A control terminal (e.g., a gate) of the transistor 112 is coupled to a control terminal of the transistor 111, and a second terminal (e.g., a drain) of the transistor 112 acts as a second terminal of the slave current path of the current mirror 110.

The first terminal of the resistor 120 is directly coupled to the first terminal (e.g., the source) of the transistor 111. The first terminal of the resistor 130 is directly coupled to the first terminal (e.g., the source) of the transistor 112. The LDO regulator 100 is provided with the resistors 120 and 130 having large resistance values. The resistors 120 and 130 are disposed between the element operating in the sub-threshold region and the power line 140. That is, the current mirror 110 has a source degeneration technology. The resistors 120 and 130 are not sensitive to current disturbance. Therefore, the resistors 120 and 130 may effectively reduce current mismatch in process variation, which makes the LDO regulator 100 work more stably in the sub-threshold region.

Figure 2:
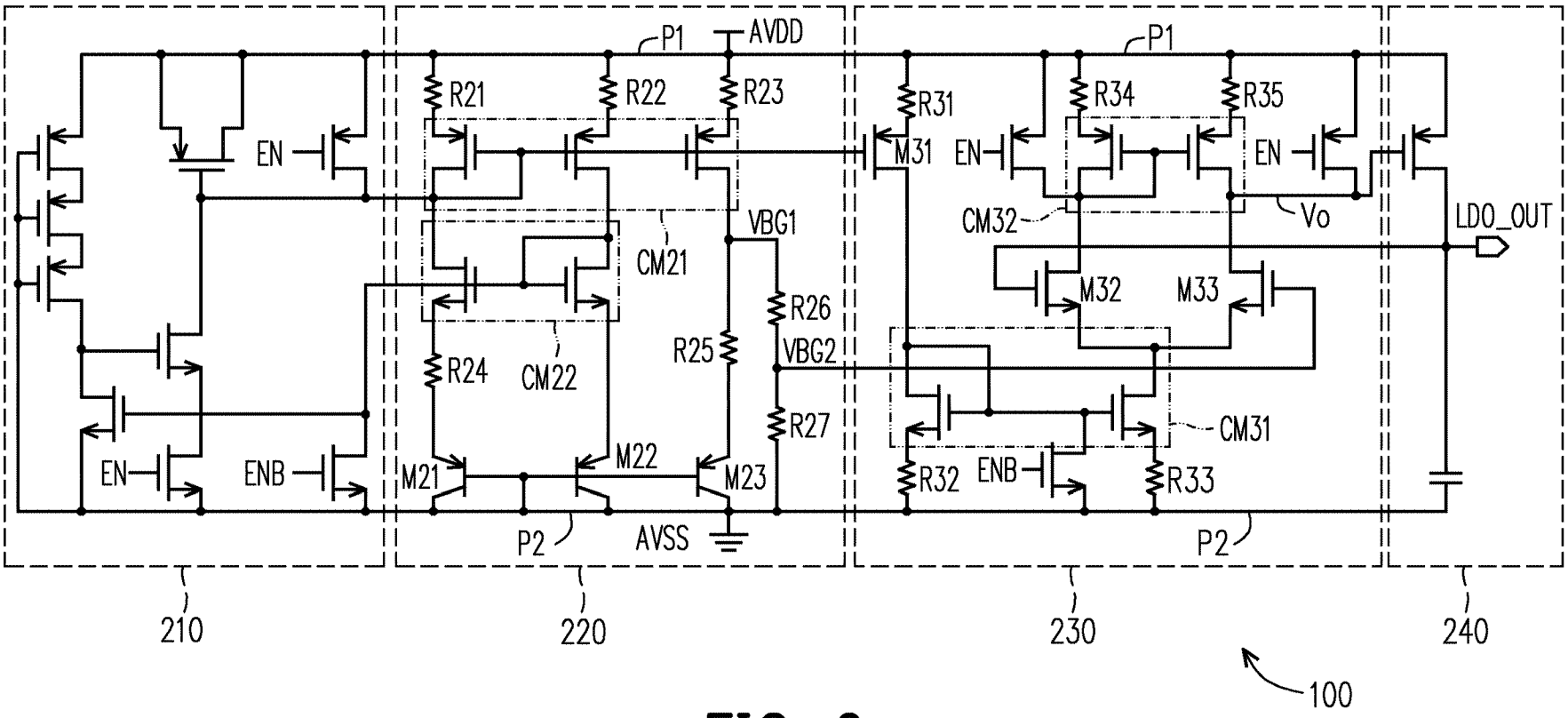
FIG. 2 is a schematic circuit block diagram illustrating the LDO regulator shown in FIG. 1 according to one embodiment of the present invention.

FIG. 2 is a schematic circuit block diagram illustrating the LDO regulator 100 shown in FIG. 1 according to one embodiment of the present invention. EN and ENB shown in FIG. 2 are enable signals. The LDO regulator 100 shown in FIG. 2 includes a start-up circuit 210, a reference voltage generator 220, an error amplifier 230 and an output stage circuit 240. The start-up circuit 210 is coupled to the reference voltage generator 220. The start-up circuit 210 may start up the reference voltage generator 220.

The reference voltage generator 220 may generate a bandgap voltage VBG2. In the embodiment shown in FIG. 2, the reference voltage generator 220 includes a resistor R21, a resistor R22, a resistor R23, a resistor R24, a resistor R25, a resistor R26, a resistor R27, a current mirror CM21, a current mirror CM22, a transistor M21, a transistor M22 and a transistor M23. The current mirror CM21 operates in a sub-threshold region. The current mirror CM21 has a master current path, a first slave current path and a second slave current path. The current mirror CM21 shown in FIG. 2 may be analogized with reference to the related description of the current mirror 110 shown in FIG. 1.

A first terminal of the resistor R21 is directly coupled to a first terminal of the master current path of the current mirror CM21. A first terminal of the resistor R22 is directly coupled to a first terminal of the first slave current path of the current mirror CM21. A first terminal of the resistor R23 is directly coupled to a first terminal of the second slave current path of the current mirror CM21. Second terminals of the resistors R21, R22 and R23 are directly coupled to a power line P1. In the embodiment shown in FIG. 2, the power line P1 is configured to transmit a system voltage AVDD. The resistors R21, R22 and R23 shown in FIG. 2 may be analogized with reference to the related descriptions of the resistors 120 and 130 shown in FIG. 1.

The current mirror CM22 has a master current path and a slave current path. A first terminal of the master current path of the current mirror CM22 is coupled to a second terminal of the first slave current path of the current mirror CM21. A first terminal of the slave current path of the current mirror CM22 is coupled to the second terminal of the master current path of the current mirror CM21. A first terminal of the resistor R24 is coupled to a second terminal of the slave current path of the current mirror CM22. A first terminal (e.g., an emitter) of the transistor M21 is coupled to a second terminal of the resistor R24. A second terminal (e.g., a collector) and a control terminal (e.g., a base) of the transistor M21 are coupled to a second power line P2. In the embodiment shown in FIG. 2, the power line P2 is configured to transmit a grounding voltage AVSS. A first terminal (e.g., an emitter) of the transistor M22 is coupled to a second terminal of the master current path of the current mirror CM22. A second terminal (e.g., a collector) and a control terminal (e.g., a base) of the transistor M22 are coupled to the power line P2.

A first terminal of the resistor R25 is coupled to the second terminal of the second slave current path of the current mirror CM21. The second terminal of the second slave current path of the current mirror CM21 outputs a bandgap voltage VBG1. A first terminal (e.g., an emitter) of the transistor M23 is coupled to a second terminal of the resistor R25. A second terminal (e.g., a collector) and a control terminal (e.g., a base) of the transistor M23 are coupled to the power line P2. A first terminal of the resistor R26 is coupled to the second terminal of the second slave current path of the current mirror CM21. A second terminal of the resistor R26 outputs a bandgap voltage VBG2. A first terminal of the resistor R27 is coupled to the second terminal of the resistor R26. A second terminal of the resistor R27 is coupled to the power line P2.

The error amplifier 230 is coupled to an output terminal of the reference voltage generator 220 to receive the bandgap voltage VBG2. The error amplifier 230 has at least one current mirror and at least one resistor. The at least one current mirror may be analogized with reference to the related description of the current mirror 110 shown in FIG. 1, and the at least one resistor may be analogized with reference to the related descriptions of the resistors 120 and 130 shown in FIG. 1. The error amplifier 230 may generate an output voltage Vo according to the bandgap voltage VBG2 and the LDO voltage LDO_OUT. The output stage circuit 240 is coupled to an output terminal of the error amplifier 230 to receive the output voltage Vo. The output stage circuit 240 may generate the LDO voltage LDO_OUT according to the output voltage Vo.

In the embodiment shown in FIG. 2, the error amplifier 230 includes a transistor M31, a transistor M32, a transistor M33, a resistor R31, a resistor R32, a resistor R33, a resistor R34, a resistor R35, a current mirror CM31 and a current mirror CM32. The transistor M31 operates in a sub-threshold region. A control terminal (e.g., a gate) of the transistor M31 is coupled to the current mirror CM21 to receive a bias voltage. A first terminal of the resistor R31 is directly coupled to a first terminal (e.g., a source) of the transistor M31. A second terminal of the resistor R31 is directly coupled to a power line P1. The resistor R31 shown in FIG. 2 may be analogized with reference to the related description of the resistor 130 shown in FIG. 1, and the transistor M31 shown in FIG. 2 may be analogized with reference to the related description of the transistor 112 shown in FIG. 1.

The current mirror CM31 operates in the sub-threshold region. The current mirror CM31 has a master current path and a slave current path. A first terminal of the master current path of the current mirror CM31 is coupled to a second terminal (e.g., a drain) of the transistor M31. A first terminal of the resistor R32 is directly coupled to a second terminal of the master current path of the current mirror CM31. A second terminal of the resistor R32 is directly coupled to a power line P2. A first terminal of the resistor R33 is directly coupled to a first terminal of the slave current path of the current mirror CM31. A second terminal of the resistor R33 is directly coupled to the power line P2. The resistors R32 and R33 shown in FIG. 2 may be analogized with reference to the related descriptions of the resistors 120 and 130 shown in FIG. 1, and the current mirror CM31 shown in FIG. 2 may be analogized with reference to the related description of the current mirror 110 shown in FIG. 1.

The current mirror CM32 operates in the sub-threshold region. The current mirror CM32 has a master current path and a slave current path. A first terminal of the resistor R34 is directly coupled to a first terminal of the master current path of the current mirror CM32. A second terminal of the resistor R34 is directly coupled to the power line P1. A first terminal of the resistor R35 is directly coupled to a first terminal of the slave current path of the current mirror CM32. A second terminal of the resistor R35 is directly coupled to the power line P1. The resistors R34 and R35 shown in FIG. 2 may be analogized with reference to the related descriptions of the resistors 120 and 130 shown in FIG. 1, and the current mirror CM32 shown in FIG. 2 may be analogized with reference to the related description of the current mirror 110 as shown in FIG. 1.

A first terminal (e.g., a drain) of the transistor M32 is coupled to a second terminal of the master current path of the current mirror CM32. A second terminal (e.g., a source) of the transistor M32 is coupled to a second terminal of the slave current path of the current mirror CM31. A control terminal (e.g., a gate) of the transistor M32 is coupled to the output stage circuit 240 to receive the LDO voltage LDO_OUT. A first terminal (e.g., a drain) of the transistor M33 is coupled to a second terminal of the slave current path of the current mirror CM32. The second terminal of the slave current path of the current mirror CM32 provides the output voltage Vo to the output stage circuit 240. A second terminal (e.g., a source) of the transistor M33 is coupled to the second terminal of the slave current path of the current mirror CM31. A control terminal (e.g., a gate) of the transistor M33 is coupled to the reference voltage generator 220 to receive the bandgap voltage VBG2.

Based on the above, the LDO regulator 100 of the present embodiment is provided with the resistors R21, R22, R23, R31, R32, R33, R34 and R35 having large resistance values. The resistors are disposed between the elements operating in the sub-threshold region and the power lines, that is, the current mirrors CM21, CM31 and CM32 have a source degeneration technology. The resistors R21 to R23 and R31 to R35 having large resistance values are not sensitive to current disturbance. Therefore, the resistors may effectively reduce current mismatch in process variation, which makes the LDO regulator 100 work more stably in the sub-threshold region.

Although the invention is described with reference to the above embodiments, the embodiments are not intended to limit the invention. A person of ordinary skill in the art may make variations and modifications without departing from the spirit and scope of the invention. Therefore, the protection scope of the invention should be subject to the appended claims.

What is claimed is:

1. A low dropout (LDO) regulator, configured to generate an LDO voltage, wherein the LDO regulator comprises:

at least one current mirror; and at least one resistor, wherein a first terminal of the at least one resistor is directly coupled to the at least one current mirror, and a second terminal of the at least one resistor is directly coupled to a power line; further comprising: a reference voltage generator, configured to generate a bandgap voltage; an error amplifier, coupled to an output terminal of the reference voltage generator to receive the bandgap voltage and configured to generate an output voltage according to the bandgap voltage and the LDO voltage, wherein the error amplifier comprises the at least one current mirror and the at least one resistor, the first terminal of the at least one resistor is directly coupled to the at least one current mirror, and the second terminal of the at least one resistor is directly coupled to the power line; and an output stage circuit, coupled to an output terminal of the error amplifier to receive the output voltage and configured to generate the LDO voltage according to the output voltage; wherein the reference voltage generator comprises: a first current mirror, comprising a first master current path, a first slave current path and a second slave current path; a first resistor, wherein a first terminal of the first resistor is directly coupled to a first terminal of the first master current path, and a second terminal of the first resistor is directly coupled to a first power line; a second resistor, wherein a first terminal of the second resistor is directly coupled to a first terminal of the first slave current path, and a second terminal of the second resistor is directly coupled to the first power line; a third resistor, wherein a first terminal of the third resistor is directly coupled to a first terminal of the second slave current path, and a second terminal of the third resistor is directly coupled to the first power line; a second current mirror, comprising a second master current path and a third slave current path, wherein a first terminal of the second master current path is coupled to a second terminal of the first slave current path, and a first terminal of the third slave current path is coupled to a second terminal of the first master current path; a fourth resistor, wherein a first terminal of the fourth resistor is coupled to a second terminal of the third slave current path; a first transistor, wherein a first terminal of the first transistor is coupled to a second terminal of the fourth resistor, and a second terminal and a control terminal of the first transistor are coupled to a second power line; a second transistor, wherein a first terminal of the second transistor is coupled to a second terminal of the second master current path, and a second terminal and a control terminal of the second transistor are coupled to the second power line; a fifth resistor, wherein a first terminal of the fifth resistor is coupled to a second terminal of the second slave current path; a third transistor, wherein a first terminal of the third transistor is coupled to a second terminal of the fifth resistor, and a second terminal and a control terminal of the third transistor are coupled to the second power line; a sixth resistor, wherein a first terminal of the sixth resistor is coupled to the second terminal of the second slave current path, and a second terminal of the sixth resistor outputs the bandgap voltage; and a seventh resistor, wherein a first terminal of the seventh resistor is coupled to the second terminal of the sixth resistor, and a second terminal of the seventh resistor is coupled to the second power line.

2. The LDO regulator according to claim 1, wherein the power line is configured to transmit a system voltage or a grounding voltage.

3. The LDO regulator according to claim 1, wherein the at least one current mirror operates in a sub-threshold region.

4. The LDO regulator according to claim 1, wherein the first current mirror operates in a sub-threshold region.

5. The LDO regulator according to claim 1, wherein the error amplifier comprises:

a first transistor, wherein the first transistor operates in a sub-threshold region;

a first resistor, wherein a first terminal of the first resistor is directly coupled to a first terminal of the first transistor, and a second terminal of the first resistor is directly coupled to a first power line;

a first current mirror, comprising a first master current path and a first slave current path, wherein a first terminal of the first master current path is coupled to a second terminal of the first transistor;

a second resistor, wherein a first terminal of the second resistor is directly coupled to a second terminal of the first master current path, and a second terminal of the second resistor is directly coupled to a second power line;

a third resistor, wherein a first terminal of the third resistor is directly coupled to a first terminal of the first slave current path, and a second terminal of the third resistor is directly coupled to the second power line;

a second current mirror, comprising a second master current path and a second slave current path;

a fourth resistor, wherein a first terminal of the fourth resistor is directly coupled to a first terminal of the second master current path, and a second terminal of the fourth resistor is directly coupled to the first power line;

a fifth resistor, wherein a first terminal of the fifth resistor is directly coupled to a first terminal of the second slave current path, and a second terminal of the fifth resistor is directly coupled to the first power line;

a second transistor, wherein a first terminal of the second transistor is coupled to a second terminal of the second master current path, and a second terminal of the second transistor is coupled to a second terminal of the first slave current path; and a third transistor, wherein a first terminal of the third transistor is coupled to a second terminal of the second slave current path, the second terminal of the second slave current path provides the output voltage to the output stage circuit, and a second terminal of the third transistor is coupled to the second terminal of the first slave current path.

6. The LDO regulator according to claim 5, wherein the first current mirror and the second current mirror operate in the sub-threshold region.

7. The LDO regulator according to claim 5, wherein a control terminal of the second transistor is coupled to the output stage circuit to receive the LDO voltage, and a control terminal of the third transistor is coupled to the reference voltage generator to receive the bandgap voltage.

8. The LDO regulator according to claim 1, further comprising:

a start-up circuit, coupled to the reference voltage generator and configured to start up the reference voltage generator.

* * * * *